US007143757B1

(12) United States Patent
Cooper

(10) Patent No.: US 7,143,757 B1
(45) Date of Patent: Dec. 5, 2006

(54) COMPOUND BOW WITH CAM ARRANGEMENT

(76) Inventor: Gary L. Cooper, 2106 Evening Dr., Pocahontas, AR (US) 72455

( * ) Notice: Subject to any disclaimer, the term of this patent is extended or adjusted under 35 U.S.C. 154(b) by 438 days.

(21) Appl. No.: 10/245,540

(22) Filed: Sep. 17, 2002

(51) Int. Cl.
*F41B 5/10* (2006.01)

(52) U.S. Cl. ..... 124/25.6; 124/900

(58) Field of Classification Search ..... 124/25.6, 124/900
See application file for complete search history.

(56) References Cited

U.S. PATENT DOCUMENTS 5,975,067 A * 11/1999 Strother ..... 124/25.6
6,321,736 B1 11/2001 McPherson
6,371,098 B1 * 4/2002 Winther ..... 124/25.6 X

FOREIGN PATENT DOCUMENTS

WO WO 0159391 A1 1/2001

* cited by examiner

*Primary Examiner*—John A. Ricci
(74) *Attorney, Agent, or Firm*—Polster, Lieder, Woodruff & Lucchesi, L.C.

(57) ABSTRACT

An archery bow (B) having at least one draw force module (1*a* or 1*b*). The module includes a concentric bowstring (3) pathway (12*a*) and at least one eccentric cable (6*a*) pathway (7*a*) with a decreasing radius proportional to the increasing spring rate of the flexing limb so the peak weight remains the same through a portion of the draw force curve and decreases at the end.

8 Claims, 3 Drawing Sheets

COMPOUND BOW WITH CAM ARRANGEMENT

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

Compound bow design has evolved from an initial design featuring force draw processing modules in which a bowstring is wound or fed around two eccentric grooves in modules located at each tip of each limb of the bow. This construction provides significantly more energy storage than is possible with conventional longbows; while at the same time providing a tremendous advantage in low holding weight (letoff) at a full draw position of the bow. This design, which is still in use, permits both a sustained draw and controlled aiming. Since then, successful compound bow design has utilized this double eccentric module concept to produce the force draw curves now available and well-known to those skilled in the art. More recent bow design involves single cam bows in which a string feed groove is added to one double eccentric groove module, with the other module being replaced by an idler wheel. While a double eccentric groove module provides desired energy storage and letoff, the eccentric, swinging hinge action, produces a rough "jerk" to the bow during release. It is therefore desirable to provide a bow that is smoother, faster, quieter and more accurate than previous designs.

An optimal force draw curve rises, peaks, and falls consistently, without bumps or ripples. The result is a smoother draw with improved energy storage that produces faster speeds. A smoother release, greater accuracy, with less vibration and noise also result. Nock travel of the bow needs to be straight and level so all the energy in the limbs is transferred directly to the arrow to produce this greater speed and increased accuracy. The advantage of a compound bow over a longbow results from the use of limb tip modules and cables to regulate the energy storage developed when the limbs (which act as springs) are compressed. When a longbow is drawn, and as the limbs are increasingly compressed, the rate of resistance increases. That is, draw weight increases as draw length increases due to a progressively higher spring rate in the limbs as they are bent backward toward the archer as he draws the bow.

BRIEF SUMMARY OF THE INVENTION

In the present invention, a bowstring is routed from a module using a concentric or substantially non-eccentric bowstring groove. An eccentric limb cable groove on the module is designed to provide a peak draw weight earlier in the draw cycle (compared to that of a longbow), and to hold this peak draw weight for a greater distance of pull, by wrapping progressively less cable, thereby diminishing the rate of limb compression as draw length increases. By matching the increasing spring rate with decreasing limb compression rate during the draw, the peak draw weight is sustained for a longer distance of pull, resulting in greater stored energy and faster arrow speed for a given peak draw weight. A further advantage of the present invention is providing substantial letoff of bowstring pull at the end of the draw cycle by having a limb cable attached to a limb module groove with an inferior angle of pull close to the axle, while the bowstring is attached to a module groove of superior leverage. Preferably this bowstring letoff is at least 50%, and allows a comfortable holding and aiming weight.

In prior constructions, the draw cycle and letoff were achieved using an eccentric bowstring module groove of increasing radius, and an eccentric limb module cable groove of decreasing radius. In the bow of this invention, the draw cycle and letoff are achieved using a substantially non-eccentric or concentric bowstring module groove with little or no variation in leverage, and using an eccentric limb cable module groove of decreasing radius to achieve the desired amount of letoff. This produces smoother module rotation and a smoother and consistent bowstring wrap and results in less noise and vibration at release. An important advantage of the invention is that use of a concentric or substantially non-eccentric bowstring groove, with complementary eccentric rigging grooves, enhances straight and level nock travel so to improve arrow speed and accuracy.

BRIEF DESCRIPTION OF THE SEVERAL VIEWS OF THE DRAWINGS

In the drawings.

Corresponding reference characters illustrate corresponding points throughout the several views of the drawings

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
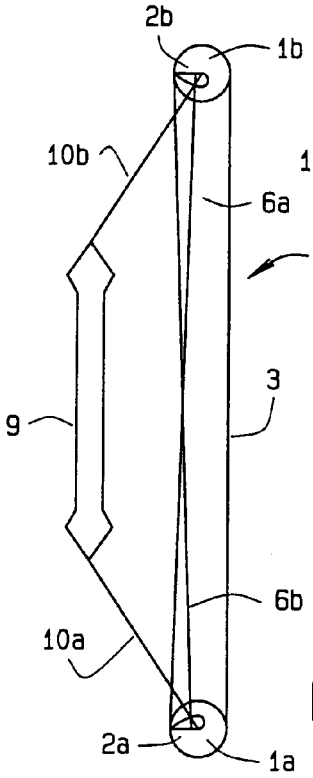
FIG. 1 illustrates a novel compound bow of the present invention having unique force draw modules.

Referring to the drawings, as shown in FIG. 1, a compound bow B has a bow handle 9 with separate limbs 10*a* and 10*b* extending from the respective lower and upper ends of the handle. A force draw module 1*a* of the present invention is mounted on lower limb 10*a* via an axle 2*a* and a second force draw module 1*b* is mounted on upper limb 10*b* via an axle 2*b*. A bowstring 3 is attached to, and routed around force draw modules 1*a* and 1*b*. A string or cable 6*a* is attached to force draw module 1*a* and terminates at axle 2*b* which mounts the force draw module 1*b* to upper limb 10*b*. A second string or cable 6*b* is attached to force draw module 1*b* and terminates at axle 2*a* which mounts force draw module 1*a* to lower limb 10*a*. The axles provide respective axes of rotation for the modules. The force draw modules comprise circular cams concentrically mounted on their respective axles.

Figure 3:
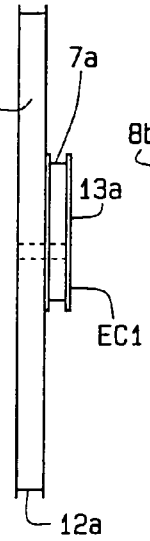
FIG. 3 is an end view of a force draw module of the invention illustrating a non-eccentric bowstring groove, eccentric cable groove, and axle hole.
Figure 2:
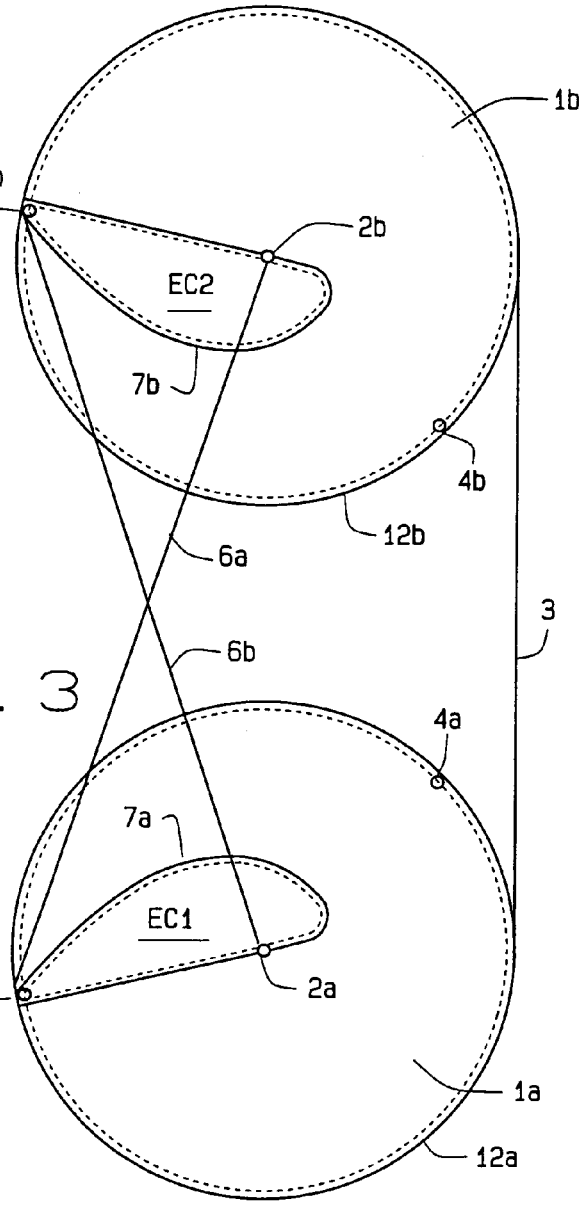
FIG. 2 is an enlarged schematic representation of the rigging of the bow shown in FIG. 1.

In FIG. 2, a rigging of bow B is shown in which bowstring 3 is attached to lower module 1*a* at an attachment point 4*a*. The bowstring is spooled counterclockwise in a non-eccentric bowstring track or groove 12*a* which extends about the circumference of module 1*a*. That is, there is a constant radius of curvature of the force draw module about its axis of rotation. The bowstring then spans upwardly to module 1*b* where it is spooled counterclockwise in a non-eccentric bowstring track 12*b* extending circumferentially about module 1*b*. The bowstring terminates at an attachment point 4*b*. Cable 6*a* now attaches to force draw module 1*a* at an attachment point 8*a* of a cable track or groove 7*a* of an eccentric cam EC1 and terminates at axle 2*b*. It will be noted that the length of groove 7*a* is shorter than the length of groove 12*a*. An end view of this configuration is shown in FIG. 3. Cable 6*b* attaches to force draw module 1*b* at an attachment point 8*b* of a cable groove 7*b* in an eccentric cam EC2. This cable terminates at axle 2*a*. In FIG. 3, groove 12*a* for bowstring 3, and groove 7*a* for cable 6*a* are shown adjacent each other. Preferably, the grooves 7*a* and 12*a* are ½ inch or less apart. In each instance, the pathway for the respective bowstring or cable extends between the force draw modules and the concentric or eccentric cam surfaces provided by the modules.

Figure 4:
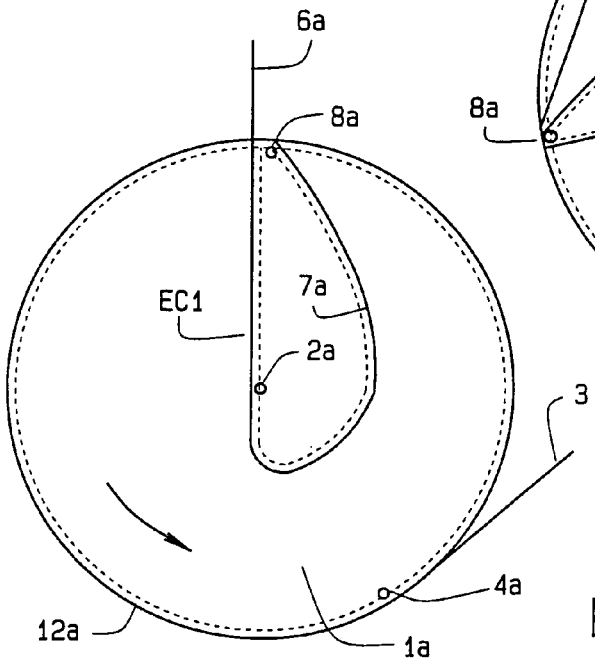
FIG. 4 is an elevation view depicting the force draw module as it appears at full draw.
Figure 5:
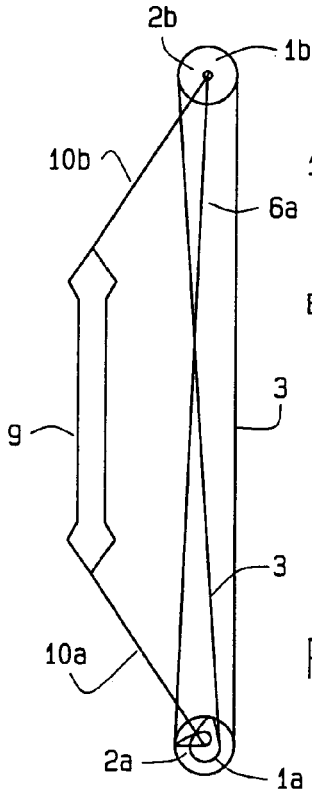
FIG. 5 is a view similar to FIG. 1 but with the compound bow having only one force draw module to vary the force draw cycle.
Figure 7:
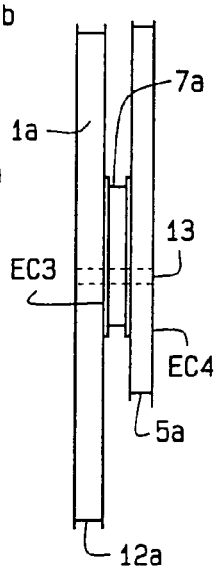
FIG. 7 is an end view of the force draw module of FIG. 6 illustrating the non-eccentric bowstring groove, eccentric cable groove, second eccentric bowstring track, and axle hole.

FIG. 4 illustrates force draw module 1*a* as it appears at full draw, it being understood that module 1*b* would similarly appear. At full draw, bowstring 3 has been pulled so it has been un-spooled from module 1*a* as the module rotates counterclockwise (as indicated by the arrow). Cable 6*a* has correspondingly been spooled by this rotation of the force draw module. In FIG. 4, cable 6*a* is shown to spool around cable groove 7*a* in eccentric cam EC1. With cable 6*a* in the position shown, it is directly above the position of axle 2*a*. In this orientation, upper limb 10*b* of the bow has little leverage to spring back and un-spool cable 6*a*. However, the bowstring now requires much less force to hold it in its full draw position making it easier to aim an arrow and hold the bow prior to shooting. Although not shown in FIG. 4, those skilled in the art will appreciate that the draw module and eccentric cam configuration at the opposite end of the bow is substantially identical in mirror image. Importantly, the force draw modules increase the spring rate of the limbs while the compression rate of the limbs decreases during the drawing of an arrow. The peak draw weight is now sustained for a longer distance of pull on the bowstring. This produces greater stored energy and faster arrow speed, when the arrow is released, for a given peak draw weight. Specifically, the force draw modules effect a bowstring holding weight which, at full draw, is at least 40% less than the peak bowstring drawing weight of conventional bows.

In the embodiment of the invention shown in FIGS. 5–8, only one force draw module 1*a*' is used to vary a force draw cycle. In this embodiment, two eccentric cams EC3 and EC4 respectively are commonly attached to force draw module 1*a*' so to form a cam assembly. All three components rotate in common about an axle 13. The other draw module 1*b* now has no eccentric cams attached to it, and so functions as an idler pulley. Bowstring 3 to attaches module 1*a*' at attachment point 14*a*, extends through track 12*a* of the module, spans the length of the bow, and extends through track 12*b* of module 1*b*. The bowstring then is rerouted back to module 1*a*' where it passes through track 5*a* of eccentric cam EC4, and back to attachment point 4*a*. Importantly, at least 50% of the length of the pathway for bowstring 3 is non-eccentric in relation to axle 13.

Figure 6:
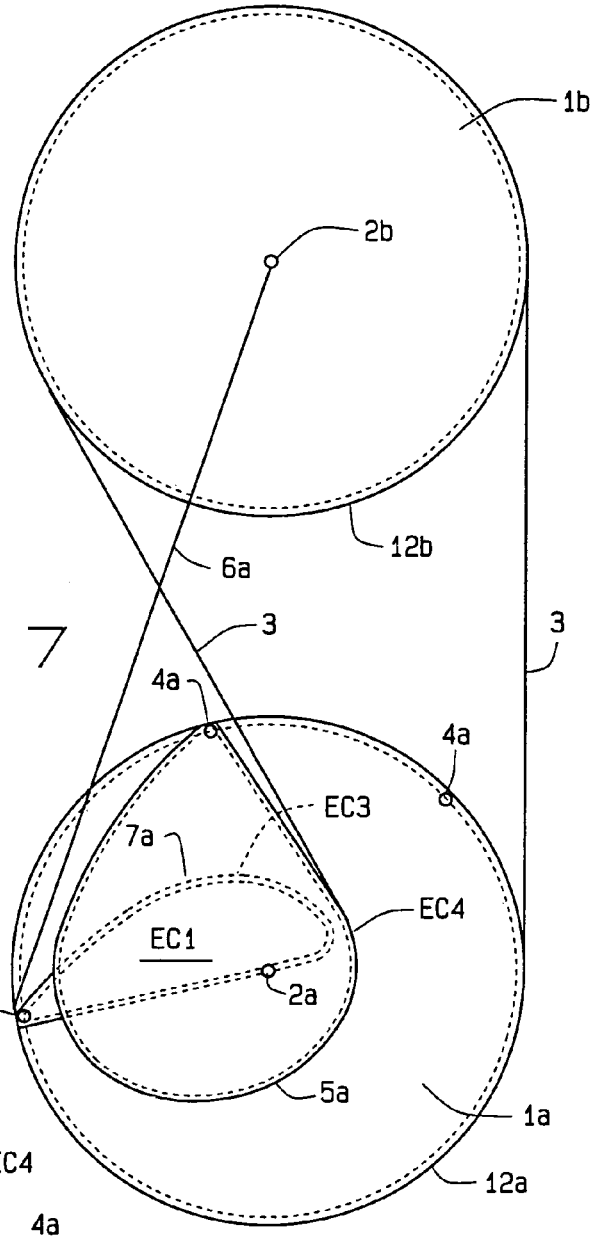
FIG. 6 is an enlarged schematic representation of the rigging on the bow shown in FIG. 5.

This is as shown in FIG. 6. Cable 6*a* attaches to axle 2*b* of module 1*b*, then extends the length of the bow, through track 7*a* of eccentric cam EC3 on force draw module 1*a*', and terminates at attachment point 8*a*.

In FIG. 6, bowstring 3 is shown to attach to module 1*a*' at attachment point 14*a*. The bowstring spools counterclockwise in non-eccentric bowstring track 12*a* and spans upwardly to upper module 1*b*, trains around force draw module 1*b* in bowstring track 12*b*, and is routed back to force draw module 1*a*'. Here, the bowstring spools around a second eccentric bowstring track 5*a* and attaches to the force draw module at point 4*a*. This arrangement is further shown in the end view of FIG. 7 view with the first non-eccentric bowstring groove 12*a*, eccentric cable groove 7*a*, eccentric bowstring track 5, and an axle hole 13.

Figure 8:
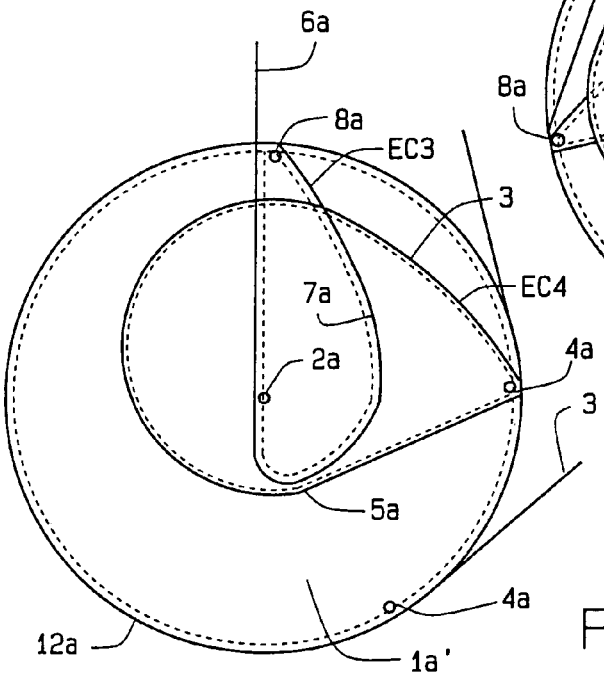
FIG. 8 is an elevation view similar to FIG. 4 depicting the force draw module at full draw.

In FIG. 8, the full draw condition of bow B is shown for this novel rigging configuration. As with the configuration of FIG. 4, bowstring 3 has been pulled so it is unspooled from force draw module 1*a*'. Again, rotation of the module is counterclockwise. The other end of the bowstring, which is fitted into eccentric track 5*a* of module 1*a*', is likewise un-spooled from this second eccentric bowstring track. Cable 6*a* has correspondingly been spooled by its rotation around eccentric cable groove 7*a* and is now in a position of close proximity to axle 2*a*. Again, because of the relationship between cable 6*a* and axle 2*a*, there is little leverage available for upper limb 10*b* of the bow to spring back and un-spool the cable. However, this still has the advantage of allowing bowstring 3 to be held with relatively little force at this full draw position, making it easier to aim an arrow and hold the bow prior to shooting.

Other embodiments of the invention are shown in FIGS. 9–12.

Figure 9:
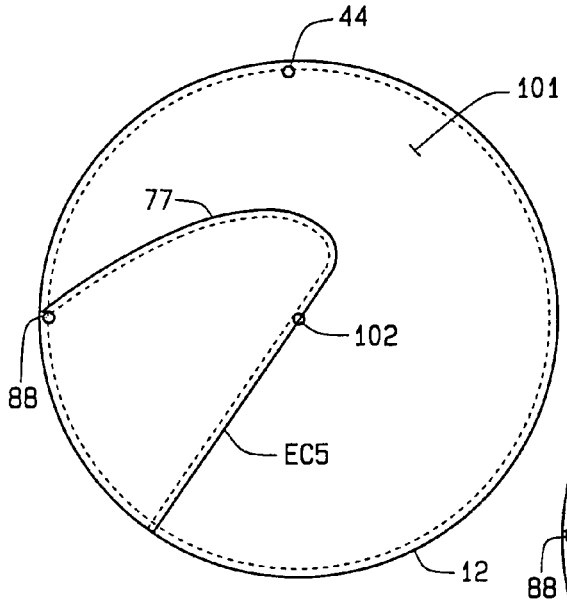
FIG. 9 is an elevation view of a third embodiment of the invention illustrating an alternate eccentric cable groove configuration and bowstring attachment point.
Figure 10:
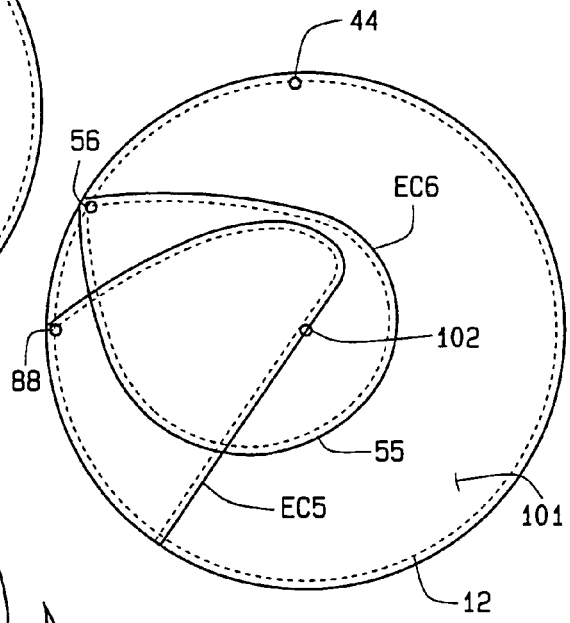
FIG. 10 is an elevation view of a modification of the embodiment of FIG. 9.

In the embodiment of FIG. 9, a force draw module 101, which rotates about an axle 102, has a bowstring track 12 with an attachment point 44 for the bowstring. Now, an eccentric cam EC5 is fixedly attached to the draw module. The eccentric includes a cable track 77 with a cable attachment point 88 at one end of the track. In FIG. 10, a variation of the embodiment of FIG. 9 is shown to include both eccentric cam EC5, and another eccentric cam EC6. Cam EC6 has a cable track 55 with a cable attachment point 56 at one end of the track.

Figure 11:
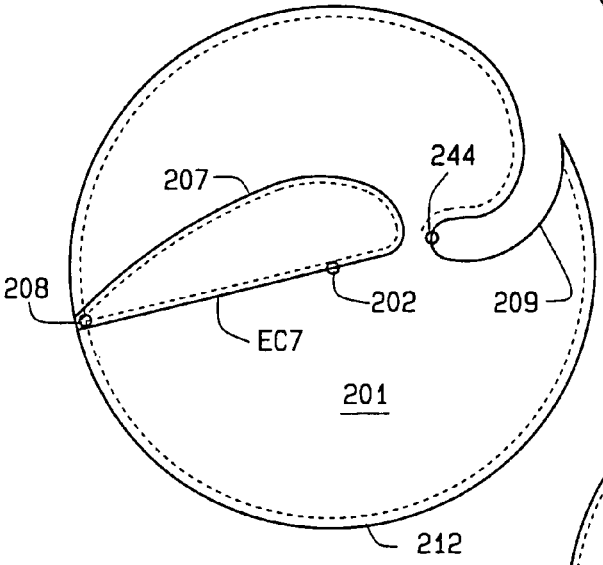
FIG. 11 is an elevation view of an embodiment of the invention having a force draw module with a substantially non-eccentric bowstring groove and bowstring attachment point; and, FIG. 12 is an elevation view of an embodiment of the invention with a force draw module having a substantially non-eccentric bowstring groove, eccentric cable groove, cable attachment point, and bowstring attachment point.

Referring to FIG. 11, a force draw module 201 rotates about an axis 202 and includes an eccentric cam EC7 with cable track 207 and attachment point 208. The force draw module now has a notch 209 curving inwardly from the outer edge of the module. The force draw module has a bowstring track 212 with an attachment point 244 for the bowstring. This attachment point is located at the inner end of the notch.

Figure 12:
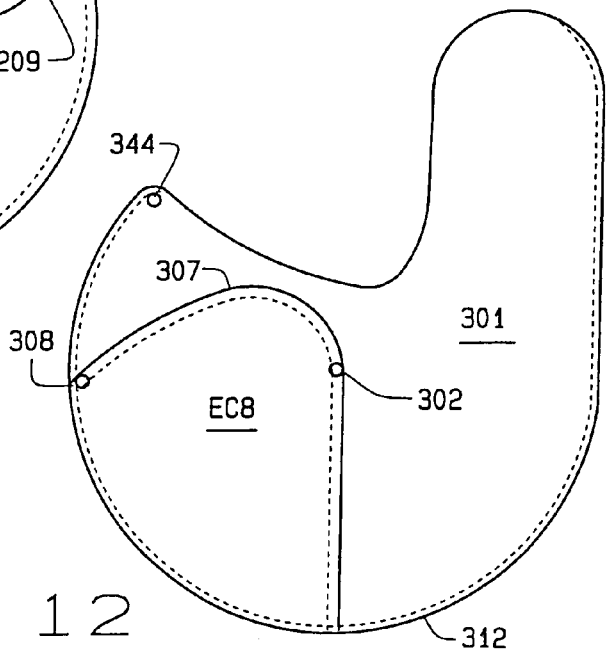

Finally, FIG. 12 depicts a force draw module which has a reverse J shape as shown in the drawing. The module includes a bowstring track 312 which extends from an upper end of the module (as shown in FIG. 12), down the front of the module, underneath the module and along the rear edge of the module, terminating at a bowstring attachment point 344. The force draw module is mounted on an axle 302. An eccentric cam EC8 is fixedly attached to the force draw module. The eccentric includes a cable track 307 with a cable attachment point 308 at one end of the track.

An important feature of the present invention is the range of rotation of the bowstring modules. Eccentric bowstring modules of previous designs, store the majority of the energy, and effect letoff, while rotating approximately 180 degrees. This is due to the eccentric shape of the module. With the non-eccentric bowstring modules of the present invention, the bulk of the energy is stored when the module rotates approximately 270 degrees. This is caused by the eccentric limb cable groove rotating from its peak weight position to its full letoff position through 90 degrees of motion.

Consider, for example, an eccentric module which rotates through a 180 degree range to full letoff, and another, non-eccentric, module which rotates through a 270 degree range to full letoff. If both modules effect the same draw length, the 180 degree module must be of a greater diameter than the 270 degree module. Since both modules rotate through a 90 degree range while lowering the draw weight to full letoff, less draw length is used during letoff in the 270 degree module than with the 180 degree module. That is, the 270 degree module holds the peak weight for a longer draw distance before the weight lessens in the letoff phase, as compared to the 180 degree module. More energy is thus stored with the 270 degree non-eccentric, thereby the 2700 module produces greater arrow speed.

Numerous variations in construction of the non-eccentric module of this invention, within the scope of the appended claims, may occur to those skilled in the art based upon the foregoing disclosure. As an example, and not by way of limitation, varying bowstring and cable module pathways will alter the force draw curve. These pathways may be of a variety of forms including grooves, posts, screws, or other means serving to direct the bowstring or cable in the novel manner described herein. The lengths, as well as the shapes, of the pathways may also vary. Further, instead of having one piece draw force modules with multiple pathways, the draw force modules themselves may be modular and have separate pathways joined together by screws or other means. Any means convenient to direct a cable away from the arrow path may be used. Single groove or double groove idlers common to the art may be used. The modules may be weighted or balanced. Only one module with the disclosed advantage need be concentric or substantially non-eccentric to achieve the benefits derived from the invention. The second module may be of any shape. The other modules described herein may be mounted on other structures, for example, cross-bows, that propel arrows. As such, the above examples are merely illustrative.

In view of the above, it will be seen that the several objects and advantages of the present invention have been achieved and other advantageous results have been obtained.

Having thus described the invention, what is claimed and desired to be secured by Letters Patent is:

1. In an archery bow comprising:

a handle;

limbs extending from each end of the handle, and a force draw module mounted to at least one of the limbs, the module rotating about an axis and providing a concentric pathway and an eccentric pathway, a bowstring extending between the limbs and moving through the concentric pathway; and a cable also extending between the limbs and moving through the eccentric pathway, the force draw module increasing a spring rate of the limbs as the compression rate of the limbs decreases during the draw of an arrow for a peak draw weight to be sustained for a longer distance of pull on the bowstring, thus producing greater stored energy and faster arrow speed, when the arrow is released, for a given peak draw weight, the improvement comprising an end of said bowstring being connected to said concentric pathway at a point to provide a rotation of said module greater than 230 degrees to full letoff while the eccentric cable groove rotates from its peak weight position to its full letoff position.

2. The bow of claim 1 wherein a first one of said force draw modules is mounted to an outer end of one of the limbs, and a second force draw module is mounted to an outer end of the other limb, both force draw modules rotating about an axis and each module providing a concentric pathway and an eccentric pathway, the bowstring extending between the limbs and moving through the concentric pathway on each module, and separate cables respectively extending between a force draw module mounted to one of the limbs and the force draw module on the other limb, one end of said bowstring being connected to said concentric pathway of one of said modules at a point to provide a rotation of said module greater than 230 degrees to full letoff, and the other end of said bow string being connected to said concentric pathway of the other module at a point to provide a rotation of said module greater than 230 degrees to full letoff while the eccentric cable groove of each module rotates from its peak weight position to its full letoff position.

3. The bow of claim 2 in which the eccentric pathway at full draw is not more than ½ inch from the axis.

4. The bow of claim 2 in which one of the eccentric cams is larger than the other eccentric cam, whereby two cable pathways of different diameters rotate about a common axis, thereby to provide a concentric pathway for the bowstring, and eccentric pathways for each of two cables.

5. The bow of claim 4 in which at least 50% of the length of the pathway for the bowstring is non-eccentric in relation to the axle about which the module rotates.

6. The bow of claim 2 further including a notch curving inwardly from the outer edge of the force draw module, an attachment point for the bowstring being located at the inner end of the notch.

7. The bow of claim 2 wherein the ends of said bow string are connected to said to said concentric pathways to provide rotations of approximately 270 degrees.

8. The bow of claim 1 wherein an end of said bow string is connected to said concentric pathway to provide a rotation of approximately 270 degrees.

* * * * *